US008164466B2

(12) United States Patent
Jang

(10) Patent No.: US 8,164,466 B2
(45) Date of Patent: Apr. 24, 2012

(54) APPARATUS AND METHOD FOR DETECTING A COMMUNICATION ABNORMALITY IN A MULTI-TYPE AIR CONDITIONER

(75) Inventor: Sung Hwan Jang, Gwangju (KR)

(73) Assignee: Samsung Electronics Co., Ltd. (KR)

( * ) Notice: Subject to any disclaimer, the term of this patent is extended or adjusted under 35 U.S.C. 154(b) by 1321 days.

(21) Appl. No.: 11/827,416

(22) Filed: Jul. 11, 2007

(65) Prior Publication Data

US 2008/0095046 A1 Apr. 24, 2008

(30) Foreign Application Priority Data

Oct. 24, 2006 (KR) ..... 10-2006-0103712

(51) Int. Cl.
*G08B 21/00* (2006.01)
*G09F 25/00* (2006.01)

(52) U.S. Cl. .... 340/635; 340/679; 340/652; 340/286.01

(58) Field of Classification Search ..... None
See application file for complete search history.

(56) References Cited

U.S. PATENT DOCUMENTS

| | | | | |
|---|---|---|---|---|
| 4,390,953 | A * | 6/1983 | Johnstone | 700/177 |
| 7,869,889 | B2 * | 1/2011 | Flanders et al. | 700/79 |
| 2005/0043859 | A1 * | 2/2005 | Tsai et al. | 700/286 |
| 2007/0035407 | A1 * | 2/2007 | Capowski et al. | 340/679 |
| 2010/0238037 | A1 * | 9/2010 | Bristow et al. | 340/635 |

FOREIGN PATENT DOCUMENTS

KR 1020060073176 6/2006

* cited by examiner

*Primary Examiner* — Julie Lieu
(74) *Attorney, Agent, or Firm* — Ohlandt, Greeley, Ruggiero & Perle, LLP

(57) ABSTRACT

An apparatus and method for detecting a communication abnormality in a multi-type air conditioner is disclosed. The apparatus, which performs data communication with peripheral devices having an outdoor unit, a plurality of indoor units, a repeater and a wired remote controller, includes a level converter for serving as an interface to allow multiplex communication between the apparatus and the peripheral devices; and an abnormality detector connectable with the peripheral devices from a remote site through the level converter, the abnormality detector detecting a communication abnormality in the peripheral devices by automatically changing an operation mode thereof into a slave or master mode depending on whether an operation mode of each of the peripheral devices connected thereto is the master or slave mode. Thus, when the communication abnormality occurs, the communication abnormality can be detected in a convenient way by using the apparatus.

13 Claims, 5 Drawing Sheets

APPARATUS AND METHOD FOR DETECTING A COMMUNICATION ABNORMALITY IN A MULTI-TYPE AIR CONDITIONER

CROSS-REFERENCE TO RELATED APPLICATION

This application claims the benefit of Korean Patent Application No. 2006-103712, filed on Oct. 24, 2006 in the Korean Intellectual Property Office, the disclosure of which is incorporated herein by reference.

BACKGROUND OF THE INVENTION

1. Field of the Invention

The present disclosure relates to an apparatus and method for detecting a communication abnormality in a multi-type air conditioner, and more particularly to an apparatus and method for detecting a communication abnormality in a multi-type air conditioner, wherein the communication abnormality can be detected by automatically changing an operation mode of the apparatus into a master or slave mode and individually connecting the apparatus to components such as outdoor and indoor units.

2. Description of the Related Art

In general, a multi-type air conditioner employs a communication manner, wherein peripheral units (indoor unit, wired remote controller, repeater and the like) acting as a slave respond to the call of an outdoor unit acting as a master.

The communication manner employed in the multi-type air conditioner can be realized as 2-wire (half duplex) RS-485 communication wherein the master and slave are set in advance.

A monitoring system is additionally connected to the multi-type air conditioner employing the communication manner to check a temperature sensor, a load state, and an abnormality of the outdoor and indoor units.

However, when the outdoor unit acting as a master is malfunctioning due to open-circuit or short-circuit or when the indoor unit and the like acting as a slave are malfunctioning, a communication abnormality occurs and the monitoring system does not work.

Therefore, conventionally when a communication abnormality occurs, a communication abnormality detection apparatus should be connected to each unit to detect whether there is a communication abnormality in each unit. In this case, since the unit acting a slave does not respond without the call of the unit acting as a master, an operation mode of the communication abnormality detection apparatus should be manually changed into a master or slave mode depending on an operation mode of the connected unit. Further, since the units are disposed separately from each other, the communication abnormality detection apparatus should be moved to check every unit.

SUMMARY OF THE INVENTION

The present disclosure has been provided in order to solve the above problems. It is an aspect of the disclosure to provide an apparatus and method for detecting a communication abnormality in a multi-type air conditioner, capable of automatically changing an operation mode of the apparatus into a master or slave mode and individually connecting the apparatus at a remote site with peripheral devices disposed separately from each other.

Consistent with one aspect, an exemplary embodiment of the present disclosure provides an apparatus for detecting a communication abnormality in a multi-type air conditioner by performing data communication with peripheral devices, the peripheral devices including an outdoor unit, a plurality of indoor units, a repeater and a wired remote controller, the apparatus comprising: a level converter for serving as an interface to allow multiplex communication between the apparatus and the peripheral devices; and an abnormality detector connectable with the peripheral devices from a remote site through the level converter, the abnormality detector detecting a communication abnormality in the peripheral devices by automatically changing an operation mode thereof into a slave or master mode depending on whether an operation mode of each of the peripheral devices connected thereto is the master or slave mode.

Consistent with another aspect, an exemplary embodiment of the present disclosure provides a method for detecting a communication abnormality in a multi-type air conditioner by performing data communication with peripheral devices, the peripheral devices including an outdoor unit, a plurality of indoor units, a repeater and a wired remote controller, the method comprising: connecting each of the peripheral devices when the communication abnormality occurs and changing an operation mode into a master or slave mode depending on an operation mode of each of the connected peripheral devices; and detecting whether there is a communication abnormality in the peripheral devices by individually connecting the peripheral devices after changing the operation mode.

Additional aspects and/or advantages of the disclosure will be set forth in part in the description which follows and, in part, will be obvious from the description, or may be learned by practice of the disclosure.

BRIEF DESCRIPTION OF THE DRAWINGS

These and/or other aspects and advantages of the exemplary embodiments of the disclosure will become apparent and more readily appreciated from the following description of the embodiments, taken in conjunction with the accompanying drawings, of which.

DETAILED DESCRIPTION OF THE PREFERRED EMBODIMENTS

Figure 1:
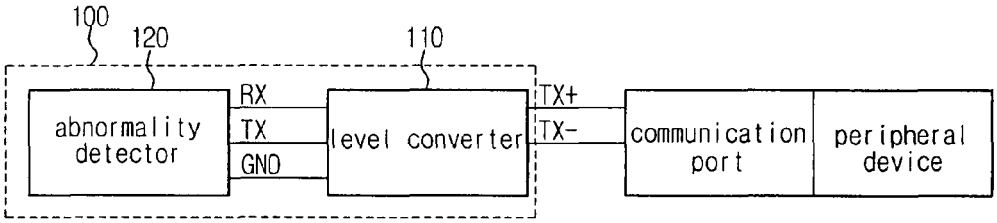
FIG. 1 is a block diagram showing a schematic configuration of a communication abnormality detection apparatus in accordance with an embodiment of the present disclosure.

Reference will now be made in detail to exemplary embodiments of the present disclosure, examples of which are illustrated in the accompanying drawings, wherein like reference numerals refer to like elements throughout. The embodiments are described below to explain the present disclosure by referring to the figures.

FIG. 1 is a block diagram showing a schematic configuration of an apparatus for detecting a communication abnormality in a multi-type air conditioner in accordance with an embodiment of the present disclosure. As shown in FIG. 1, a communication abnormality detection apparatus 100 includes a level converter 110 and an abnormality detector 120. The level converter 110 serves as an interface to allow multiplex communication between the apparatus 100 and a plurality of peripheral devices. The abnormality detector 120, which is connectable with the peripheral devices from a remote site through the level converter 110 and communication lines, detects a communication abnormality in the peripheral devices by automatically changing an operation mode thereof into a slave or master mode depending on whether an operation mode of each of the peripheral devices connected thereto is the master or slave mode.

Figure 2:
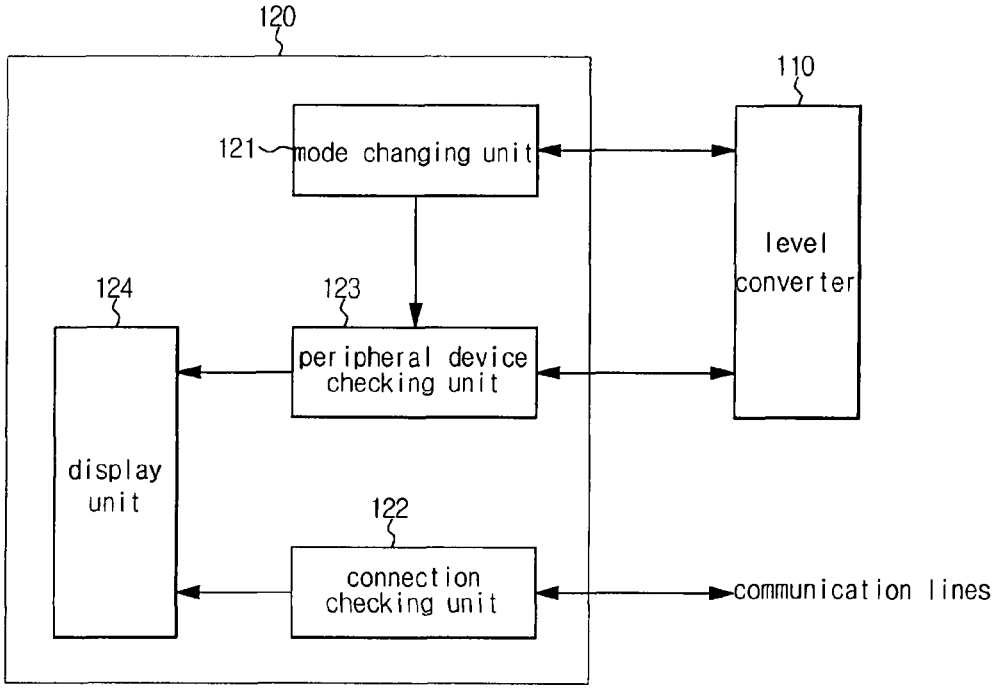
FIG. 2 is a block diagram showing a schematic configuration of an abnormality detector of the communication abnormality detection apparatus in accordance with an embodiment of the present disclosure.

As shown in FIG. 2, the abnormality detector 120 includes a mode changing unit 121, a connection checking unit 122, a peripheral device checking unit 123 and a display unit 124. The mode changing unit 121 changes the operation mode of the abnormality detector 120 into the slave or master mode by determining whether the operation mode of each of the peripheral devices connected to the abnormality detector 120 through the communication lines is the master or slave mode. The connection checking unit 122 checks whether there is an abnormality in the communication lines connecting the abnormality detector 120 to the peripheral devices. The peripheral device checking unit 123 checks whether there is a communication abnormality in the peripheral devices by changing the operation mode of the abnormality detector 120 into the master or slave mode by the mode changing unit 121 and individually connecting it to the peripheral devices. The display unit 124 displays checking results obtained by the peripheral device checking unit 123 on the screen.

The peripheral device checking unit 123 includes a remote controller checking unit for checking a wired remote controller through a second communication port only when the wired remote controller acts as a master while checking whether there is a communication abnormality in the peripheral devices.

Hereinafter, operations and effects of the communication abnormality detection apparatus having the above configuration will be described in accordance with one embodiment of the present disclosure.

Figure 3A:
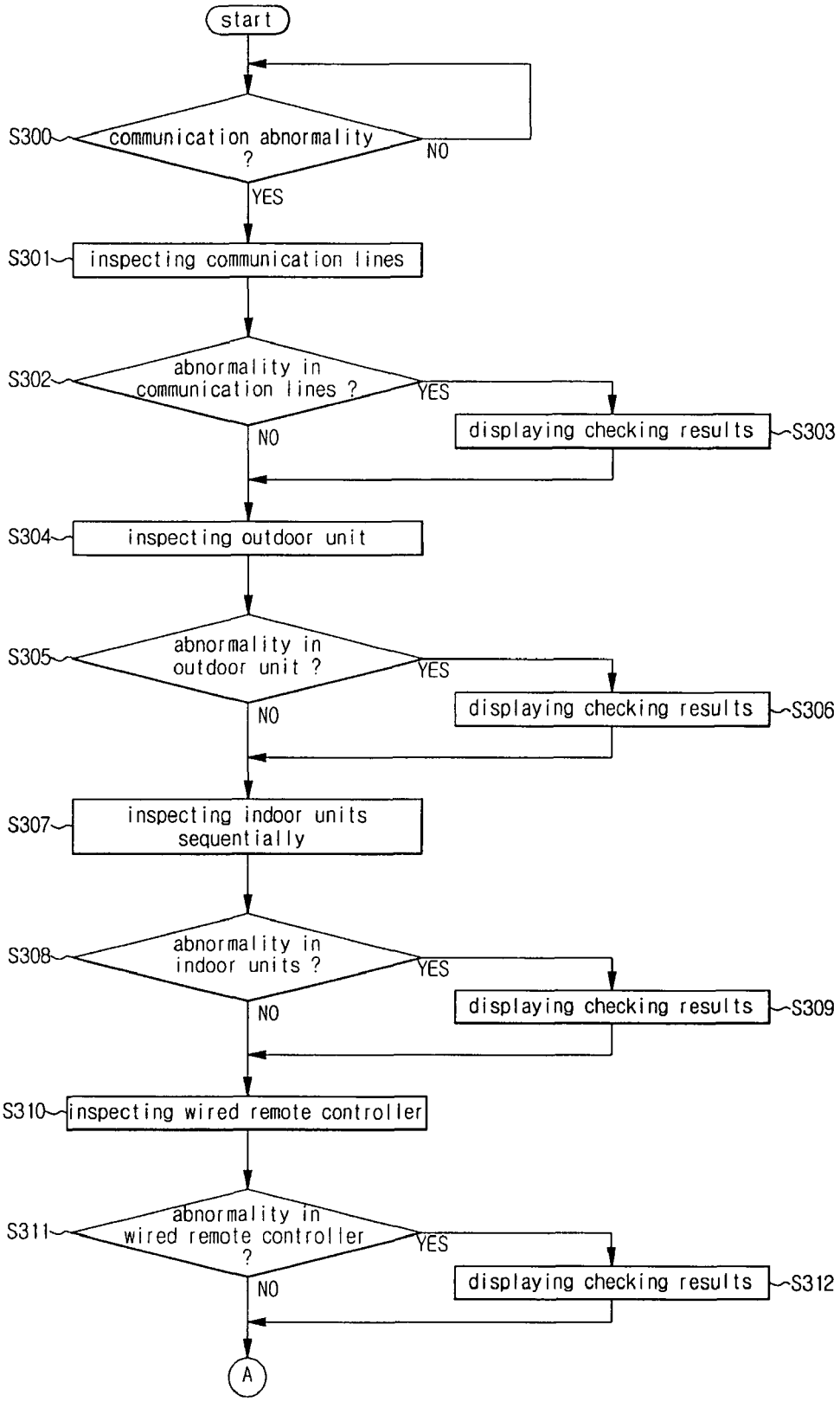
FIGS. 3A and 3B illustrate a flowchart showing a process of detecting a communication abnormality in a multi-type air conditioner in accordance with an embodiment of the present disclosure.
Figure 3B:
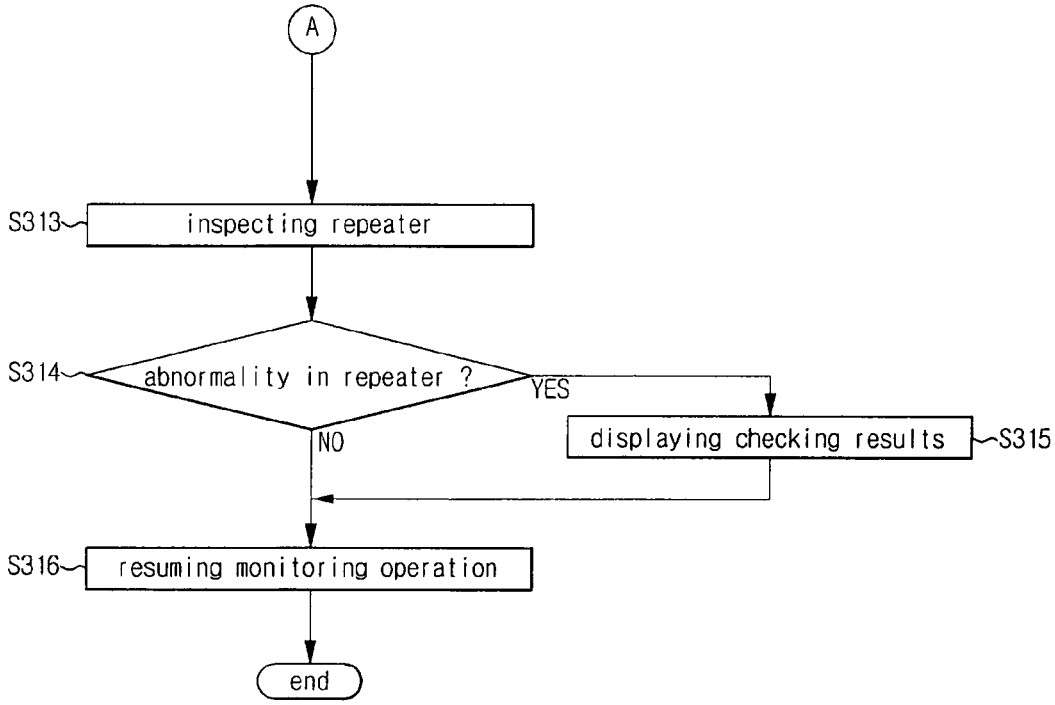
Figure 4A:
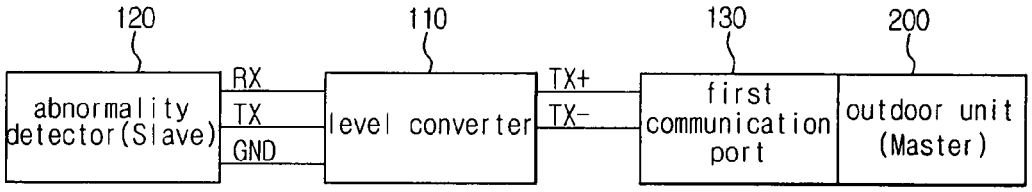
FIG. 4A is an exemplary diagram showing connection between the communication abnormality detection apparatus and an outdoor unit in accordance with an embodiment of the present disclosure.

FIGS. 3A and 3B illustrate a flowchart showing a process of detecting a communication abnormality in the multi-type air conditioner in accordance with one embodiment of the present disclosure. As shown in FIG. 3A, it is determined whether a communication abnormality occurs while monitoring the multi-type air conditioner (S300). If it is determined that the communication abnormality occurs at operation S300, first, the connection checking unit 122 inspects the communication lines (S301) and checks whether there is an abnormality in the communication lines (S302). If it is determined that there is an abnormality in the communication lines at operation S302, then checking results on the communication lines are displayed in the display unit 124 to be provided to a user (S303). If it is determined that there is no abnormality in the communication lines at operation S302, the peripheral device checking unit 123 inspects an outdoor unit (S304) and checks whether there is an abnormality in the outdoor unit (S305). At operations S304 and S305, as shown in FIG. 4A, the communication abnormality detection apparatus 100 is connected to an outdoor unit 200, and the abnormality detector 120 of the apparatus 100 determines an operation mode of the outdoor unit 200. If the outdoor unit 200 acts as a master, the abnormality detector 120 changes its operation mode into a slave mode. Then, the abnormality detector 120 functioning as a low-order unit (e.g., indoor unit) checks whether there is an abnormality in the outdoor unit 200 through a first communication port 130.

If it is determined that there is an abnormality in the outdoor unit at operation S305, checking results on the outdoor unit are displayed in the display unit 124 to be provided to the user (S306). If it is determined that there is no abnormality in the outdoor unit at operation S305, the peripheral device checking unit 123 inspects a plurality of indoor units (S307) and checks whether there is an abnormality in the indoor units (S308).

Figure 4B:
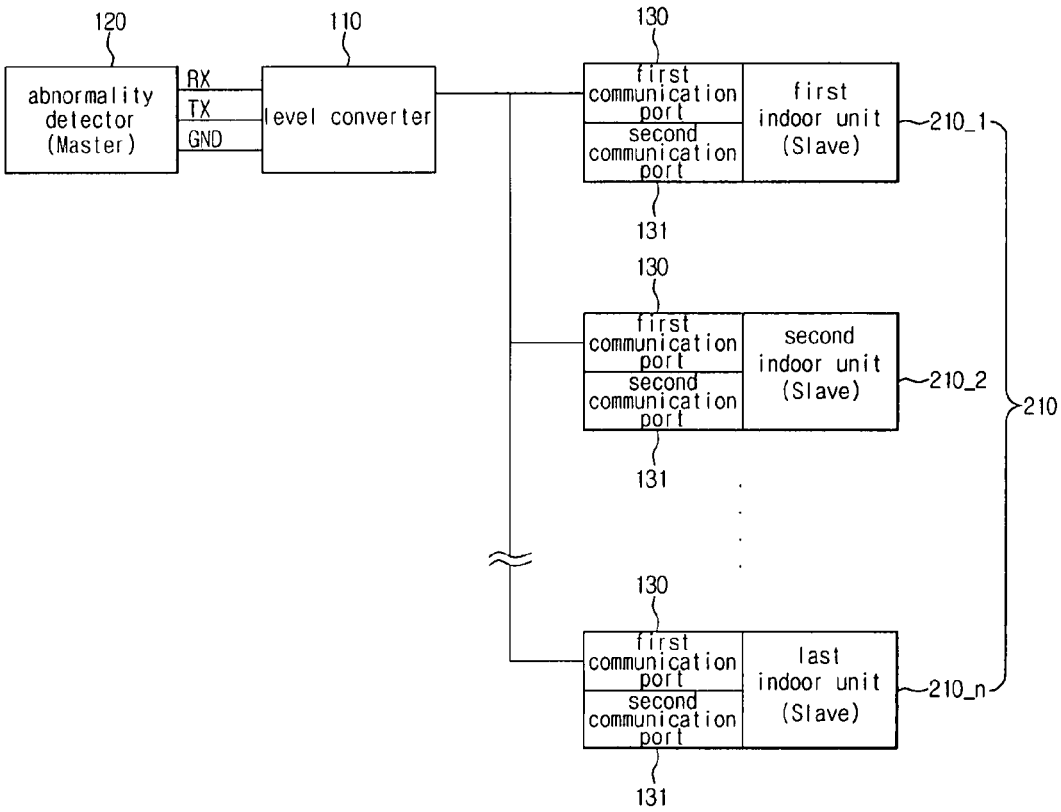
FIG. 4B is an exemplary diagram showing connection between the communication abnormality detection apparatus and a plurality of indoor units in accordance with an embodiment of the present disclosure.

At operations S307 and S308, as shown in FIG. 4B, the abnormality detector 120 connected to indoor units 210_1~210_n determines an operation mode of each indoor unit. If the indoor unit acts as a slave, the abnormality detector 120 changes its operation mode into a master mode. The abnormality detector 120 functioning as a high-order unit (e.g., outdoor unit) checks whether there is an abnormality in each of the indoor units 210_1~210_n through a first communication port 130. Namely, if there is an indoor unit making no response after sequentially calling the indoor units 210_1~210_n in an address order, it is determined that there is an abnormality in the indoor units.

If it is determined that there is an abnormality in the indoor units at operation S308, checking results on the indoor units are displayed in the display unit 124 to be provided to the user (S309). If it is determined that there is no abnormality in the indoor units at operation S308, the remote controller checking unit inspects a wired remote controller (S310) and checks whether there is an abnormality in the wired remote controller (S311).

Figure 4C:
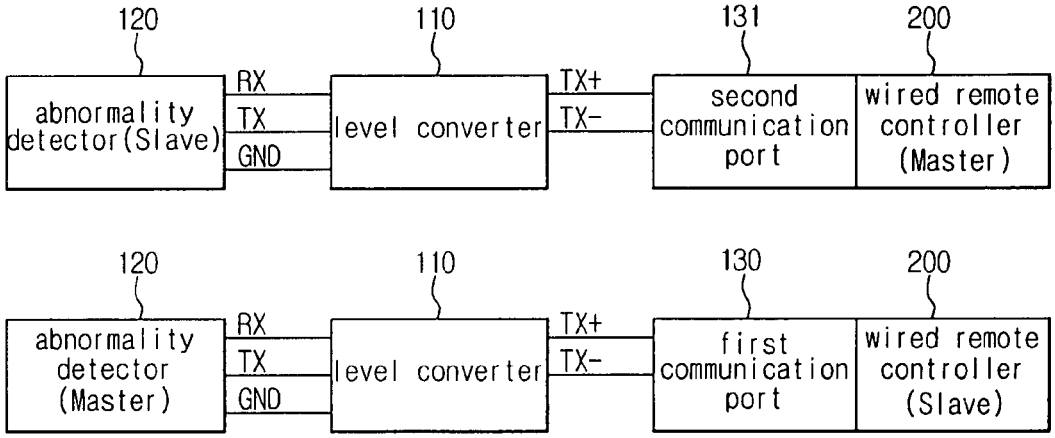
FIG. 4C is an exemplary diagram showing connection between the communication abnormality detection apparatus and a wired remote controller in accordance with an embodiment of the present disclosure.

At operations S310 and S311, as shown in FIG. 4C, the abnormality detector 120 determines whether an operation mode of a wired remote controller 220 is the master or slave mode. If the wired remote controller 220 acts as a master, the abnormality detector 120 changes its operation mode into the slave mode. That is, the abnormality detector 120 functioning as a low-order unit (e.g., indoor unit) checks whether there is an abnormality in the wired remote controller 220 through a second communication port 131. If the wired remote controller 220 acts as a slave, the abnormality detector 120 changes its operation mode into the master mode. That is, the abnormality detector 120 functioning as a high-order unit (e.g., outdoor unit) checks whether there is an abnormality in the wired remote controller 220 through the first communication port 130.

If it is determined that there is an abnormality in the wired remote controller at operation S311, checking results on the wired remote controller are displayed in the display unit 124 to be provided to the user (S312). If it is determined that there is no abnormality in the wired remote controller at operation S311, as shown in FIG. 3B, the peripheral device checking unit 123 inspects a repeater (S313) and checks whether there is an abnormality in the repeater (S314).

Figure 4D:
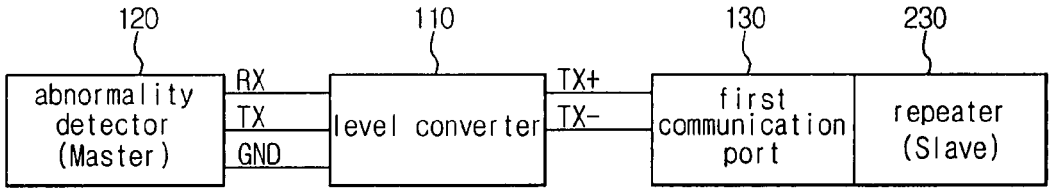
FIG. 4D is an exemplary diagram showing connection between the communication abnormality detection apparatus and a repeater in accordance with an embodiment of the present disclosure.

At operations S313 and S314, as shown in FIG. 4D, the abnormality detector 120 determines an operation mode of a repeater 230. If the repeater 230 acts as a slave, the abnormality detector 120 changes its operation mode into the master mode. That is, the abnormality detector 120 functioning as a high-order unit (e.g., outdoor unit) checks whether there is an abnormality in the repeater 230 through the first communication port 130. If it is determined that there is an abnormality in the repeater at operation S314, checking results on the repeater are displayed in the display unit 124 to be provided to the user (S315). If it is determined that there is no abnormality in the repeater at operation S314, an operation of monitoring the multi-type air conditioner is resumed (S316).

As described above, in an apparatus and method for detecting a communication abnormality in a multi-type air conditioner according to the present disclosure, the user can detect a communication abnormality in a convenient way by automatically changing the operation mode into the master or slave mode and individually connecting the apparatus to the peripheral devices such as indoor units that are disposed separately.

Although embodiments of the present disclosure have been shown and described, it would be appreciated by those skilled in the art that changes may be made in this embodiment without departing from the principles and spirit of the disclosure, the scope of which is defined in the claims and their equivalents.

What is claimed is:

1. An apparatus for detecting a communication abnormality in a multi-type air conditioner by performing data communication with peripheral devices, the peripheral devices including an outdoor unit, a plurality of indoor units, a repeater and a wired remote controller, the apparatus comprising:

a level converter for serving as an interface to allow multiplex communication between the apparatus and the peripheral devices; and an abnormality detector connectable with the peripheral devices from a remote site through the level converter, the abnormality detector detecting a communication abnormality in the peripheral devices by automatically changing an operation mode thereof into a slave or master mode depending on whether an operation mode of each of the peripheral devices connected thereto is the master or slave mode.

2. The apparatus according to claim 1, wherein the abnormality detector further comprises:

a mode changing unit for changing the operation mode of the abnormality detector into the slave or master mode by determining whether the operation mode of each of the peripheral devices connected to the abnormality detector through communication lines is the master or slave mode;

a connection checking unit for checking whether there is an abnormality in the communication lines connecting the abnormality detector to the peripheral devices;

a peripheral device checking unit for checking whether there is a communication abnormality in the peripheral devices by changing the operation mode into the master or slave mode by the mode changing unit and individually connecting it to the peripheral devices; and a display unit for displaying checking results obtained by the peripheral device checking unit on a screen.

3. The apparatus according to claim 2, wherein the peripheral device checking unit further comprises a remote controller checking unit for checking the wired remote controller through a specific communication port only when the wired remote controller acts as a master while checking whether there is a communication abnormality in the peripheral devices.

4. The apparatus according to claim 1, wherein the abnormality detector is individually connectable with the indoor units through communication lines from the remote site.

5. A method for detecting a communication abnormality in a multi-type air conditioner by performing data communication with peripheral devices, the peripheral devices including an outdoor unit, a plurality of indoor units, a repeater and a wired remote controller, the method comprising:

connecting each of the peripheral devices when the communication abnormality occurs and changing an operation mode into a master or slave mode depending on an operation mode of each of the connected peripheral devices; and detecting whether there is a communication abnormality in the peripheral devices by individually connecting the peripheral devices after changing the operation mode.

6. The method according to claim 5, wherein the connecting further comprises:

converting a level of an input voltage to allow multiplex communication with the peripheral devices.

7. The method according to claim 5, wherein the detecting further comprises:

sequentially calling the indoor units in an address order, and if there is a specific one of the indoor units making no response, determining that there is an abnormality in the specific indoor unit.

8. The method according to claim 5, wherein the changing further comprises:

changing the operation mode into the slave mode if each of the connected peripheral devices acts as a master and changing the operation mode into the master mode if each of the connected peripheral devices acts as a slave.

9. The method according to claim 5, wherein the communication abnormality is detected by changing the operation mode to function as a high-order or low-order unit depending on a function and an operation mode of each of the connected peripheral devices.

10. The method according to claim 6, wherein the communication abnormality is detected by changing the operation mode to function as a high-order or low-order unit depending on a function and an operation mode of each of the connected peripheral devices.

11. The method according to any one of claim 7, wherein the communication abnormality is detected by changing the operation mode to function as a high-order or low-order unit depending on a function and an operation mode of each of the connected peripheral devices.

12. The method according to any one of claim 8, wherein the communication abnormality is detected by changing the operation mode to function as a high-order or low-order unit depending on a function and an operation mode of each of the connected peripheral devices.

13. The method according to claim 5, wherein the detecting further comprises:

inspecting the wired remote controller through a first communication port if the wired remote controller acts as a slave;

inspecting the wired remote controller through a second communication port if the wired remote controller acts as a master; and inspecting the peripheral devices other than the wired remote controller through the first communication port.

* * * * *